United States Patent [19]

Spiegel

[11] 4,079,218

[45] Mar. 14, 1978

[54] PUFFER INTERRUPTER WITH PISTON BYPASS CHANNEL

[75] Inventor: Hubert Spiegel, Oberentfelden, Switzerland

[73] Assignee: Sprecher & Schuh Ltd. (SSA), Switzerland

[21] Appl. No.: 702,425

[22] Filed: Jul. 6, 1976

[30] Foreign Application Priority Data

Jul. 11, 1975 Switzerland ..... 9093/75

[51] Int. Cl.[2] ..... H01H 33/82

[52] U.S. Cl. ..... 200/148 A; 200/148 B

[58] Field of Search ..... 200/148 R, 148 A, 148 B, 200/150 D, 150 G

[56] References Cited

U.S. PATENT DOCUMENTS

| | | | |
|---|---|---|---|
| 3,940,583 | 2/1976 | Hertz | 200/148 R |
| 3,975,602 | 8/1976 | Hertz | 200/148 A |

*Primary Examiner*—Robert S. Macon
*Assistant Examiner*—Leonard W. Pojunas, Jr.
*Attorney, Agent, or Firm*—Ostrolenk, Faber, Gerb & Soffen

[57] ABSTRACT

A puffer interrupter has a bypass channel around the puffer piston, which channel is opened when the interrupter contacts have reached a separation greater than the maximum effective arc quenching separation.

9 Claims, 3 Drawing Figures

PUFFER INTERRUPTER WITH PISTON BYPASS CHANNEL

BACKGROUND OF THE INVENTION

This invention relates to puffer type interrupters, and more specifically relates to a novel arrangement to control the pressure created between a cylinder and piston which forces gas through the nozzle of the puffer interrupter during interruption so that the necessary operating force for operating the interrupter is reduced.

Puffer type interrupters are well known in the art wherein a pair of separable contacts are contained within a chamber which is filled with gas such as sulfur hexafluoride or another similar gas or gas mixture having good arc interruption properties. One of the contacts is fixed to a nozzle which is usually of insulation material and which is mounted on one of a piston or cylinder which are moved relative to one another when the contacts are operated in order to produce high-speed movement of fluid through the nozzle and between the separating cooperating contacts so that the arc drawn between the contacts will be extinguished. An operating mechanism is connected to the contacts in order to move the contacts and to cause relative movement between the piston and cylinder during the opening and closing operations.

In prior art puffer type interrupters, the operating mechanism is required to provide substantial operating force since the motion of the contacts to their open position is more and more strongly resisted as the pressure within the cylinder increases due to greater compression of the volume between the cylinder and the piston.

BRIEF DESCRIPTION OF THE INVENTION

The present invention recognizes that, once the contacts have passed their most effective quenching distance, it is no longer necessary to have the same magnitude of flow of gas through the nozzle as was required during the arc interruption time. In accordance with the present invention, a novel bypass conduit is provided around the piston within the cylinder such that, once the separable contacts have passed their most effective arc quenching distance, the volume under compression within the cylinder is bypassed around the piston within the cylinder, thereby to relieve the pressure within the cylinder and to permit continued relative motion between the piston and cylinder with a smaller operating force. Thus, continued pressurization takes place, thereby continuing to force interruption fluid within the nozzle but at a lower rate after the arc interruption has occurred.

Preferably, the bypass channel around the piston will have a cross-sectional area less than the minimum cross-sectional area of the nozzle to ensure continued positive flow of interrupting fluid through the nozzle.

The bypass channel may take several different forms and could, for example, include slots in the cylinder wall where these slots expose bypass channels around the edges of the piston when the piston reaches the slotted area. Alternatively, the bypass channel can consist of a tube or other similar conduit connected at spaced axial locations along the cylinder wall. Such a tube could further have valve means therein to control the effective orifice opening of the conduit.

If desired, the bypass conduit size can be continuously adjusted within given limits and in a predetermined pattern to control orifice size as the piston moves within the cylinder in the conduit or slotted region. Thus, if slots are provided in the cylinder wall, the slots may have a varying cross-section in an axial direction, thereby to change the effective cross-sectional conduit area as a function of the position of the piston within the cylinder.

DETAILED DESCRIPTION OF THE DRAWINGS

Figure 1:
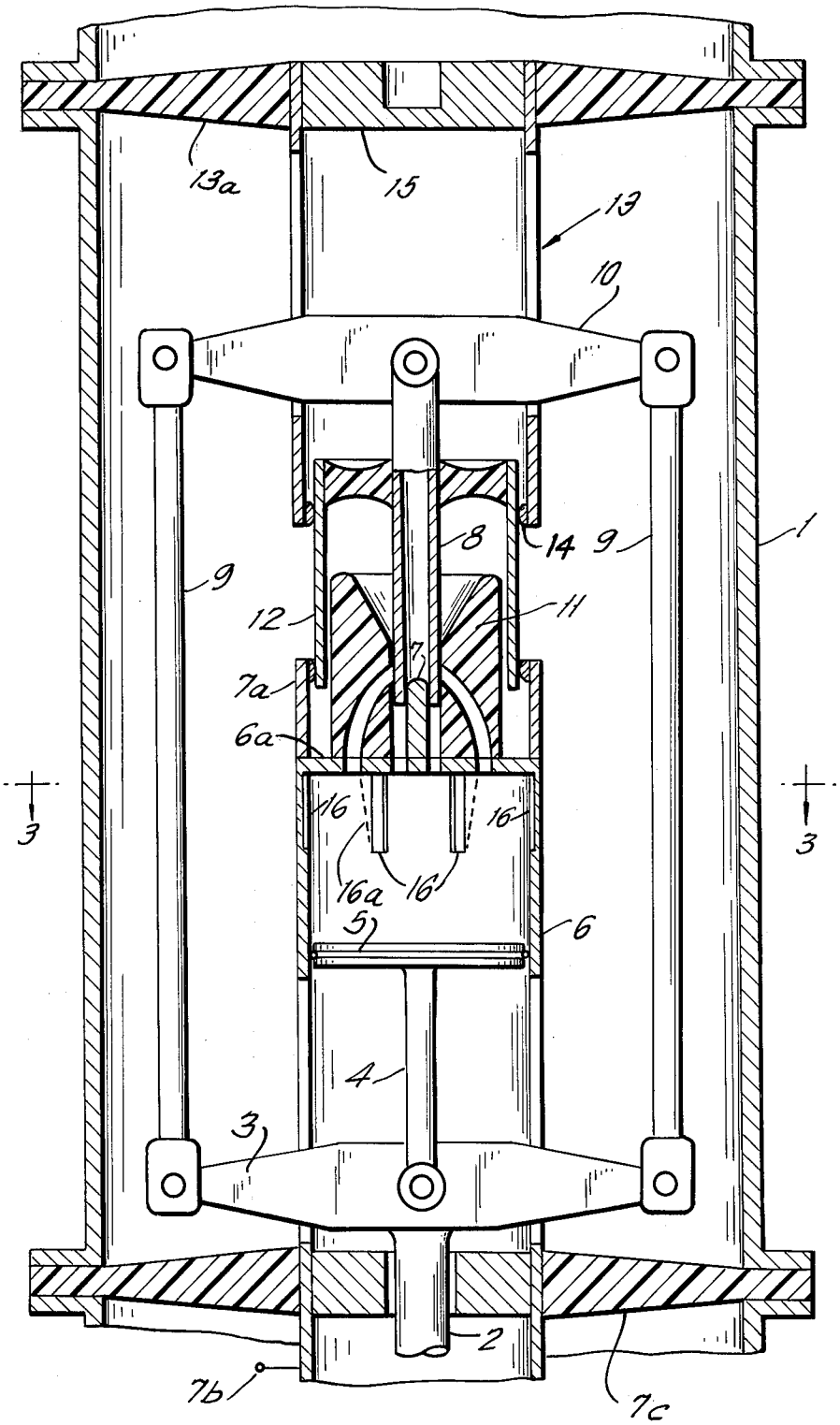
FIG. 1 is a cross-sectional view of a puffer interrupter constructed in accordance with the present invention wherein the interrupter contacts are closed.

Referring now to the drawings, the gas blast interrupter shown in the drawings is contained within a sealed metal tank housing 1 which is filled with some suitable interrupting gas, such as sulfur hexafluoride, under one or more atmospheres of pressure. A suitable operating mechanism (not shown) is connected to the operating shaft 2 and may be any suitable conventional arrangement, such as a pneumatically operated mechanism or solenoid operated mechanism or the like. The operating shaft 2 is connected to a crossarm 3 as by a suitable pivot pin connection or the like.

A link 4 extends upwardly from operating shaft 2 and crossarm 3 and is connected to a piston 5 which is guided for motion within a stationary conductive cylinder 6. Note that in the embodiment selected herein that the piston and cylinder arrangement use a movable piston and stationary cylinder. This arrangement could have been reversed if desired with the cylinder movable and the piston being fixed. If desired, the piston 5 may contain a check valve (not shown) which permits gas to flow downwardly through the piston in FIG. 1, while preventing movement of gas through piston 5 when the piston moves upwardly within the cylinder 6.

A contact 7 is then mechanically and electrically connected to the upper wall **6*a* of cylinder 6 as shown and serves as the stationary interrupting contact of the cooperating contacts of the puffer interrupter. Contact 6*a* is surrounded by and connected to an upper main sliding contact 7*a***, which is the main stationary current carrying contact of the interrupter.

Contacts 7 and **7*a* have a suitable terminal shown as terminal 7*b* which is connected to the conductive cylinder 6 at a point external of the insulation spacer 7*c* which supports cylinder 6 within container 1**.

A cooperating and movable interrupter contact 8 which cooperates with stationary interrupter contact 7 is connected to crossbar 10 carried on insulation rods 9 which are connected to the crossbar 3. Thus, as the operating shaft 2 is moved upwardly, insulation rods 9 and crossbar 10 and the interrupter contact 8 connected thereto will move from the engaged position of FIG. 1 to the disengaged position of FIG. 2.

Insulation nozzle 11 surrounds the region of engagement between interrupter 8 and cooperating interrupter contact 7. Insulation nozzle 11 is fixed to upper wall **6*a* of cylinder 6. A bridging cylindrical main contact 12 is fixed to interrupter contact 8, as shown, and is movable therewith. Cylinder 12 is in sliding contact with the interior of conductive tube 13 which has contacts 14 schematically illustrated as engaging the outer surface of cylinder 12, and the cylinder 12** then cooperates with the main stationary contact *7a* and moves between an engaged and disengaged position (FIGS. 1 and 2, respectively) with the stationary contacts *7a*.

The conductive tube 13 is then fixed to an insulation spacer *13a* and the tube terminates in a terminal block 15 as shown. The terminal 15 is then electrically connected through the cylinder 13 to the sliding bridging cylinder 12 which serves as the main movable contact of the interrupter and to the movable interrupter contact 8 which cooperates with stationary interrupter contact 7.

All interruption and closing duty of the interrupter is taken by the interrupter contacts 7 and 8 while the main current carrying duty for the interrupter is taken by the contacts 12 and *7a* which are in parallel with contacts 7 and 8.

Figure 2:
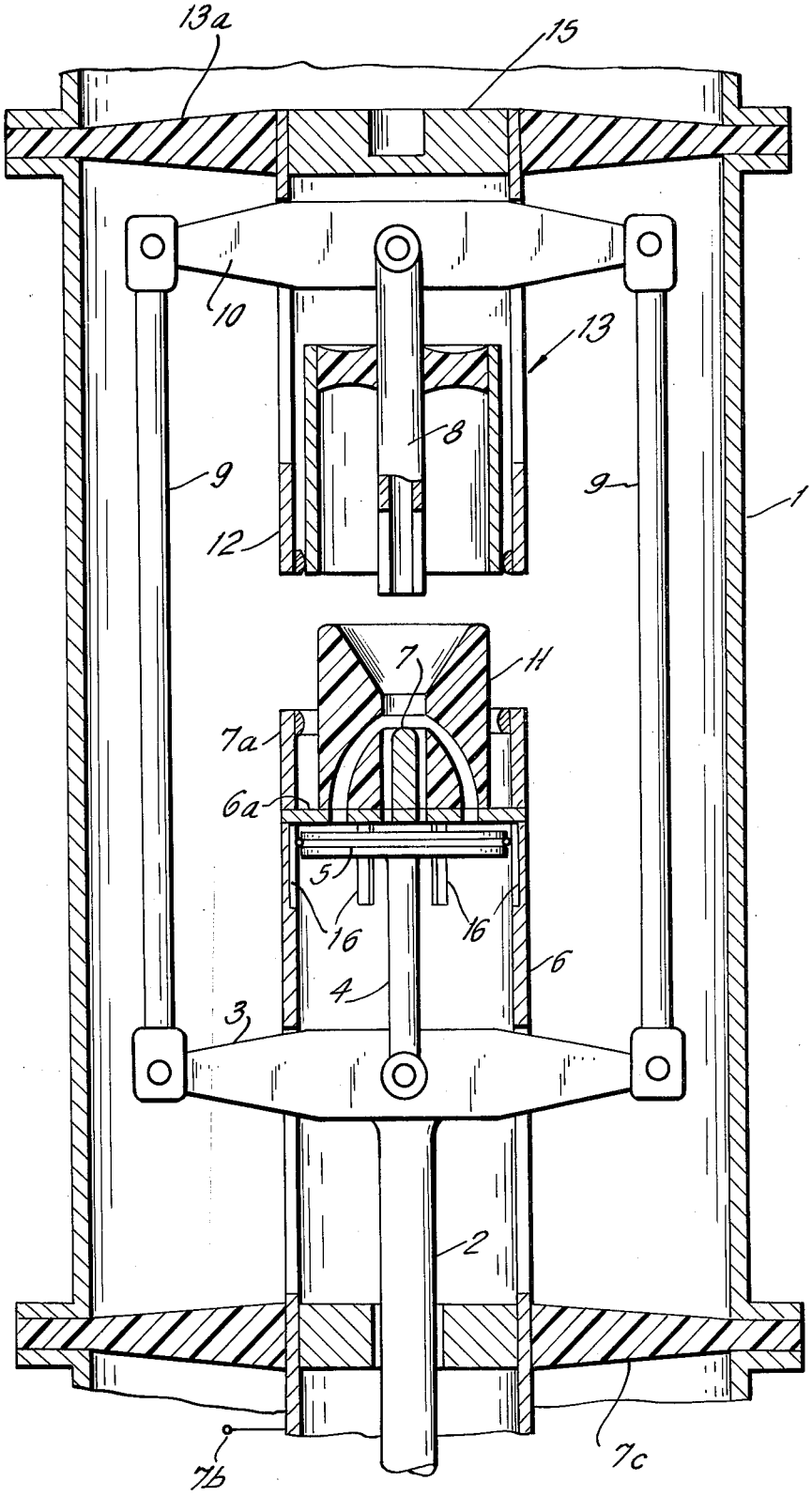
FIG. 2 is a cross-sectional view of the interrupter of the present invention wherein the interrupter contacts have been moved to their open position.
Figure 3:
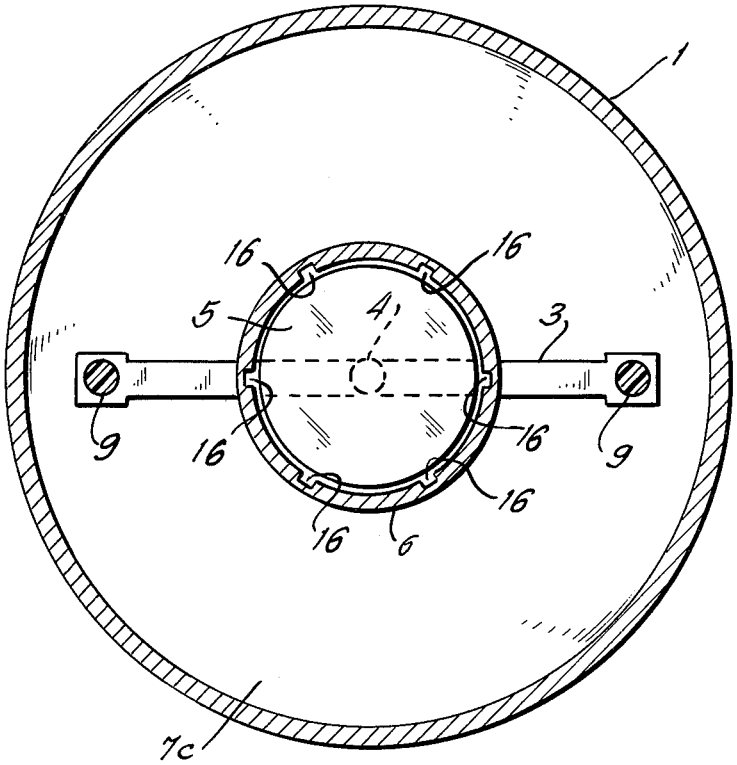
FIG. 3 is a cross-sectional view of FIG. 1 taken across the section line 3–3 in FIG. 1.

In accordance with the present invention, a conduit or bypass is placed around the piston 5 within the cylinder 6. FIGS. 1, 2 and 3 show this conduit as consisting of grooves 16 at the upper portion of the cylinder 6, with the bottom of the grooves located at a point reached by piston 5 when the separating interrupter contacts 7 and 8 have passed their most effective arc interruption distance.

The total cross-section of grooves 16 is smaller than the smallest cross-section of the internal opening of nozzle 11. If desired, the grooves may have a constant cross-section along their length or, alternatively, the cross-sectional area of the grooves may increase as indicated in dotted line *16a* in FIG. 1 to vary the effective conduit cross-sectional area as the piston moves upwardly into cylinder 6. It is further possible that other bypass channels can be provided around piston 5 including bypasses which could consist of conduits connected to the interior of cylinder 6 at spaced axial points along the cylinder wall. An appropriate valve may be provided within such conduits in order to control the effective size of the bypass opening in a fixed manner or in a variable manner, as a function of the position of piston 5 within cylinder 6.

In operation and when the circuit interrupter of FIG. 1 is to be opened and moved to the position of FIG. 2, the operating shaft 2 is moved upwardly, thereby moving the piston 5 upwardly and into cylinder 6 to compress the volume of gas within cylinder 6 above the piston 5. At the same time, the movable contact cylinder 12 begins to move upwardly along with the interrupter contact 8. These contacts are so dimensioned that contact 12 is separated from contact *7a* before the interrupter contacts 7 and 8 part.

When contacts 7 and 8 part, an arc is drawn between them and this arc is elongated as the contacts continue to separate. At the same time, the gas within cylinder 6 is compressed and is forced through the various channels shown in wall *6a* and through the nozzle orifice of nozzle 11 and between the arc drawn between separating contacts 7 and 8.

Once the optimum arc interruption distance is reached between contacts 7 and 8, the arc will be extinguished and, after arc extinction, continued gas movement through the nozzle is desirable simply to sweep clean deionized gas out of the region between the separating contacts 7 and 8. At this time, the piston 5 reaches the region of slots 16 so that the pressure above piston 5 is relieved, thereby enabling the continued upward movement of piston 5 with a reduced operating force from the operating mechanism. However, in order to ensure continued movement of gas through the nozzle 11, it is preferable that the cross-sectional area presented by the bypass channel 16 is less than the smallest area of the nozzle opening in nozzle 11.

In order to close the interrupter, the operating mechanism operates the shaft 2 downwardly from the position of FIG. 2 to the position of FIG. 1, with contacts 7 and 8 engaging first, followed by engagement of the main contacts 12 and *7a*. Thus, all interrupting and closing duty is borne by interrupter contacts 7 and 8. If desired, the piston 5 can have a one-way check valve therein to enable the easy passage of gas upwardly through the piston body 5 as the chamber above the piston is being expanded during the closing operation.

Although there has been described a preferred embodiment of this invention, many variations and modifications will now be apparent to those skilled in the art. Therefore, this invention is to be limited, not by the specific disclosure herein, but only by the appended claims.

The embodiments of the invention in which an exclusive privilege or property is claimed are defined as follows:

1. A puffer interrupter comprising, in combination: a pair of separable contacts; a relatively movable cylinder and piston; said piston being disposed within said cylinder and being axially movable therein; a gas-filled housing containing said puffer interrupter; a gas flow defining nozzle fixed to and surrounding one of said pair of separable contacts; an operating mechanism connected to one of said pair of separable contacts and to one of said cylinder or said piston for moving said one of said pair of contacts between an engaged and disengaged position, and for moving said piston relative to said cylinder to compress a volume of gas within said cylinder and to force said volume of gas toward and through the interior of said nozzle and between said pair of contacts when moving said contacts to said disengaged position; bypass channel means extending from one side of said piston within said cylinder and from said volume of gas within said cylinder, to the opposite side of said piston; said bypass channel being formed in the wall of said cylinder and being operative to pneumatically connect the opposite sides of said piston only after said pair of contacts have separated sufficiently far to cause extinction of an arc drawn between them.

2. The interrupter of claim 1 wherein said bypass channel has a cross-section less than the smallest cross-sectional area of the opening in said nozzle.

3. The interrupter of claim 1 wherein said bypass channel comprises at least one slot in the interior wall of said cylinder which is disposed adjacent the end of said cylinder toward which said piston moves when said pair of contacts move to their disengaged position; said piston passing the end of said slot only after said pair of contacts have opened to extinguish the arc between them.

4. The interrupter of claim 3 wherein said at least one slot has a varying cross-sectional area.

5. The interrupter of claim 3 wherein said bypass channel has a cross-section less than the smallest cross-sectional area of the opening in said nozzle.

6. The interrupter of claim 1 which further includes a pair of main contact members respectively connected to the contacts of said pair of separable contacts and being movable into and out of engagement with said pair of separable contacts.

7. The interrupter of claim 1 wherein said nozzle is stationarily mounted and wherein said cylinder is stationarily mounted.

8. The interrupter of claim 7 wherein said bypass channel has a cross-section less than the smallest cross-sectional area of the opening in said nozzle.

9. The interrupter of claim 8 which further includes a pair of main contact members respectively connected to the contacts of said pair of separable contacts and being movable into and out of engagement with said pair of separable contacts.

* * * * *